US005164772A

United States Patent [19]

Andoh

[11] Patent Number: 5,164,772

[45] Date of Patent: Nov. 17, 1992

[54] IMAGE FORMING APPARATUS

[75] Inventor: Kazuhiro Andoh, Tokyo, Japan

[73] Assignee: Ricoh Company, Ltd., Tokyo, Japan

[21] Appl. No.: 851,538

[22] Filed: Mar. 13, 1992

[30] Foreign Application Priority Data

Mar. 13, 1991 [JP] Japan ..... 3-74110

[51] Int. Cl.[5] ..... G03G 15/28

[52] U.S. Cl. ..... 355/233; 355/69; 355/206; 355/208; 355/229

[58] Field of Search ..... 355/204, 206, 207, 208, 355/220, 228, 229, 232, 233, 67, 69

[56] References Cited

U.S. PATENT DOCUMENTS 4,982,232 1/1991 Naito ..... 355/208
5,016,046 5/1991 Nishiyama ..... 355/69 X
5,065,184 11/1991 Iimori et al. ..... 355/208

*Primary Examiner*—A. T. Grimley
*Assistant Examiner*—P. Stanzione
*Attorney, Agent, or Firm*—Oblon, Spivak, McClelland, Maier & Neustadt

[57] ABSTRACT

An image forming apparatus using optics including a lamp and capable of operating in an enlarge mode even when the voltage to the lamp exceeds a limited voltage. While the apparatus is operated in an enlarge mode, the limitation of the voltage to the lamp can be cancelled on an operation and display panel. When the sum of the voltage to the lamp and a voltage elevation for a magnification change mode is greater than the a set voltage assigned to the lamp 102, the remaining number of copies undergoing image forming processing and the limited number of copies particular to an enlarge mode are compared. If the remaining number is greater than the limited number, an alarm inhibiting an enlarge mode is produced while an enlarge mode input is invalidated.

3 Claims, 3 Drawing Sheets

IMAGE FORMING APPARATUS

BACKGROUND OF THE INVENTION

The present invention relates to an image forming apparatus using optics including a lamp and, more particularly, to an image forming apparatus capable of operating in an enlarge mode even when the voltage applied to a lamp exceeds a predetermined limited voltage.

A copier, facsimile transceiver, laser printer or similar image forming apparatus of the type having optics including a lamp is extensively used today. This type of image forming apparatus controls the voltage to the lamp in matching relation to the potential of a latent image electrostatically formed on an image carrier, e.g., a photoconductive element and representative of a reference density pattern having a reference density. Hence, as the photoconductive element itself deteriorates due to aging, the voltage to the lamp is sequentially controlled to higher one. This brings about a problem that the lamp is deteriorated by the high voltage and has the life thereof reduced. When the lamp breaks due to the deterioration, an extremely high voltage (1 kilovolts to 2 kilovolts) is applied to the lamp itself to cause it to burst. This is not only dangerous but also causative of a failure due to the pieces of the lamp scattered around in the apparatus.

To prevent the lamp form breaking, there has been proposed an image forming apparatus having a voltage limiting unit for limiting the voltage to the lamp to below a first set voltage, an alarm unit for producing an alarm on determining that the voltage to the lamp has reached a second set voltage lower than the first set voltage, and a unit for changing the second set voltage. Implementations relating to this kind of apparatus are disclosed in Japanese Utility Model Laid-Open Publication (Kokai) Nos. 68672/1988 and 98561/1988 and Japanese Patent Laid-Open Publication No. 212930/1988.

However, the problem with the apparatus of the type limiting the quantity of light to issue from the lamp in terms of the voltage to the lamp is that, as the lamp deteriorates, it is apt to suddenly turn off in an enlarge mode although the voltage to the lamp may have some margin relative to the set value in a 1:1 mode. This problem is ascribable to the fact that since an enlarge mode needs a greater quantity of light from the lamp than in a 1:1 mode, the voltage to the lamp is automatically increased in the enlarge mode to illuminate the surface of the photoconductive element by a greater amount of light. In such a condition, therefore, images cannot be formed in the enlarge mode. While the set voltage of the lamp may be simply shifted up to eliminate such a problem, this approach does not fully settle the problem since an excessive voltage to the lamp would increae the load on the lamp to thereby quicken the breakage of the lamp. Although the lamp may be replaced in the above condition, replacing the lamp at such a stage of is not desirable from the economy standpoint since the lamp is still usable in the 1:1 mode.

SUMMARY OF THE INVENTION

It is, therefore, an object of the present invention to provide an image forming apparatus capable of operating in an enlarge mode even when the voltage to a lamp exceeds a predetermined limited voltage.

An image forming apparatus for scanning a document by optics including a lamp to expose a photoconductive element by imagewise light and scanning a pattern having a reference density by the lamp to expose the photoconductive element by the resulting reflection to thereby electrostatically form a latent image representative of the pattern on the photoconductive element of the present invention comprises a voltage limiting device for limiting the voltage to the lamp to below a first set voltage on the basis of the potential of the latent image, a controller for producing an alarm on determining that the voltage to the lamp has reached a second set voltage lower than the first set voltage, and an operation and display panel for changing the second set voltage. The limitation of the voltage to the lamp by the voltage limiting device is cancelable in an enlarge mode by a condition entered on the operation and display panel.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
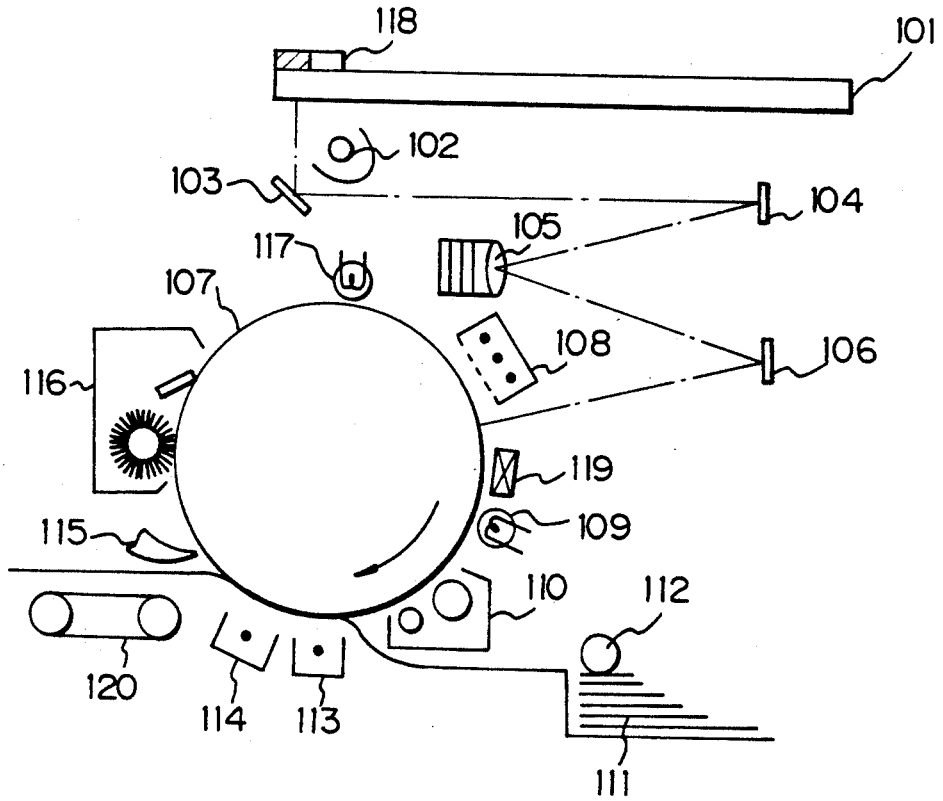
FIG. 1 is a section showing an image forming apparatus embodying the present invention.

Referring to FIG. 1 of the drawings, an image forming apparatus embodying the present invention is shown and implemented as a copier by way of example. As shown, the copier has a glass platen 101 to be loaded with a document, and a lamp 102 for scanning the document while moving in parallel to the document. The resulting imagewise reflection from the document is sequentially reflected by mirrors 103 and 104. An in-mirror lens 105 focuses the imagewise light from the mirror 104. A mirror 106 reflects the focused light from the in-mirror lens 105 onto a photoconductive element 107. The photoconductive element 107 is implemented as a drum having a selenium layer provided on the surface thereof by evaporation. A main charger 108 uniformly charges the surface of the drum 107 by corona discharge beforehand. As a result, the light from the mirror 106 electrostatically forms a latent image representative of the document on the drum 107. An eraser 109 optically removes the charge from the non-image area of the surface of the drum 107. A developing unit 110 contains a toner therein and develops the latent image formed on the drum 107 by the toner to produce a toner image. A pick-up roller 112 feeds a stack of paper sheets, or recording media, 111 one by one. A transfer charger 113 transfers the toner image from the drum 107 to the paper sheet 111. A separation charger 114 separates the paper sheet 111 electrostatically held by the drum 107 after the image transfer. A pawl 115 mechanically separates the paper sheet 11 from the drum 107 to prevent the former from wrapping around the latter. A cleaning unit 116 removes the toner remaining on the drum 107 after the image transfer. A discharge lamp 117 restores the drum 107 to the uniform potential after the cleaning unit 116 has removed the remaining toner from the drum 107. A white pattern is provided on one end of the glass platen 101 for detecting a reference white density. A potential sensor 118 is responsive to the potential of the white portion of a latent image electrostatically formed on the drum 107 by a reflection from the white pattern 118. Let the potential of such a white portion be referred to as a white portion potential hereinafter. A transport belt 120 transports the paper sheet 111 carrying the toner image thereon.

In the above construction, the lamp 102 and mirror 103 move integrally with each other to scan a document laid on the glass platen 101. The resulting reflection from the document is routed through the mirrors 103 and 104, in-mirror lens 105 and mirror 106 to the surface of the drum 107. Since the surface of the drum 107 is uniformly charged by the main charger 108 beforehand, the imagewise light electrostatically forms a corresponding latent image on the drum 107. The developing unit 110 develops the latent image by the toner to convert it to a toner image. The toner image is transferred to the paper sheet 111 fed by the pick-up roller 112 due to the operation of the transfer charger 113. The paper sheet 111 carrying the toner image thereon is separated from the drum 107 by the separation charger 114 and then by the pawl 115. The belt 120 transports the paper sheet 111 having been separated from the drum 107 to a fixing unit, not shown. After the image transfer, the cleaning unit 116 removes the remaining toner from the drum 107 to prepare the drum 107 for the next image forming cycle. The lamp 102 illuminates the white pattern 118 provided on the glass platen 101 before it illuminates the document. A reflection from the white pattern 118 is also routed through the mirrors 103 and 104, in-mirror lens 105 and mirror 106 to the drum 107 to form a white portion potential (latent image) corresponding to the white pattern 118. The potential sensor 119 measures the white portion potential developed on the drum 107.

Figure 2:
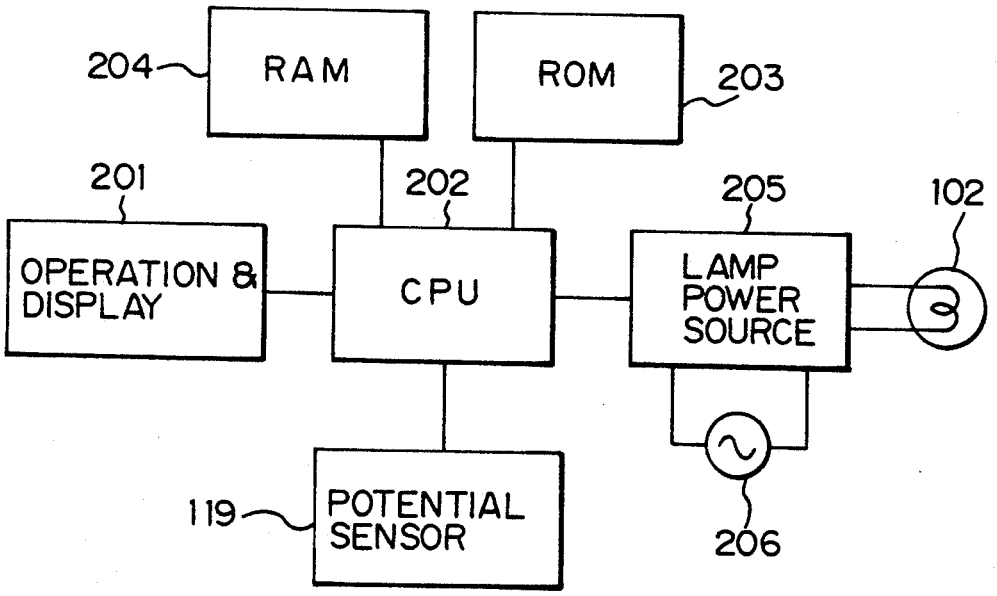
FIG. 2 is a block diagram schematically showing a control system incorporated in the embodiment.

FIG. 2 shows a control system incorporated in the copier having the above construction. As shown, the control system includes an operation and display panel 201 on which are arranged numeral keys, touch switches and other inputting means for entering various kinds of conditions, and liquid crystal, light emitting diodes and other displaying means, etc. A CPU (Central Processing Unit) 202 controls the entire copier by executing various kinds of arithmetic and logical operations. A ROM (Read Only Memory) stores programs for executing various kinds of control processing. A RAM (Random Access Memory) store the results of processing and data produced by the CPU 202. A lamp power source 205 drives the lamp 102. An AC 200-volt power source 206 applies power to the lamp power source 205. The CPU 202 writes voltage control data meant for the lamp 102 and entered on the inputting means of the operation and display panel 201 in the RAM 204. The control data is made up of a second set voltage Va, a first set voltage Vb higher than the second set voltage Va, and voltage elevation data Vc for the lamp 102 which is to be used in an enlarge mode.

Figure 3:
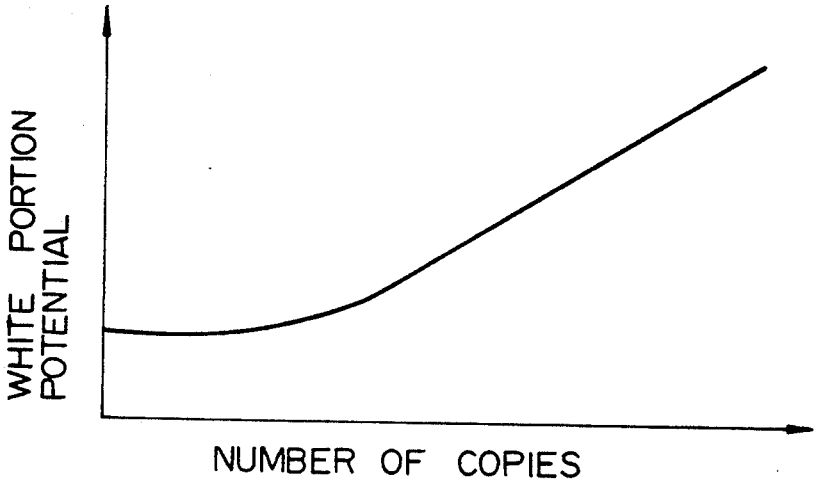
FIG. 3 is a graph showing a relation between the number of copies produced and a potential developed on a photoconductive element and associated with a white pattern having a reference density.

FIG. 3 is a graph showing a relation between the number of copies produced and the white potion potential developed by the processing of the white pattern 118. So long as the voltage to the lamp 102 is constant, the white portion potential developed on the drum 107 increases with the increase in the number of copies produced. This relation stems from the fact that the potential sequentially increases due to the decrease in the sensitivity of the drum 107 and the deterioration of the lamp 102 (decrease in the intensity of light), causing a needless toner to deposit on the background of the drum 107 (background contamination). To eliminate this problem, the control system of the embodiment executes the following control on the basis of the output of the potential sensor 119.

Figure 4:
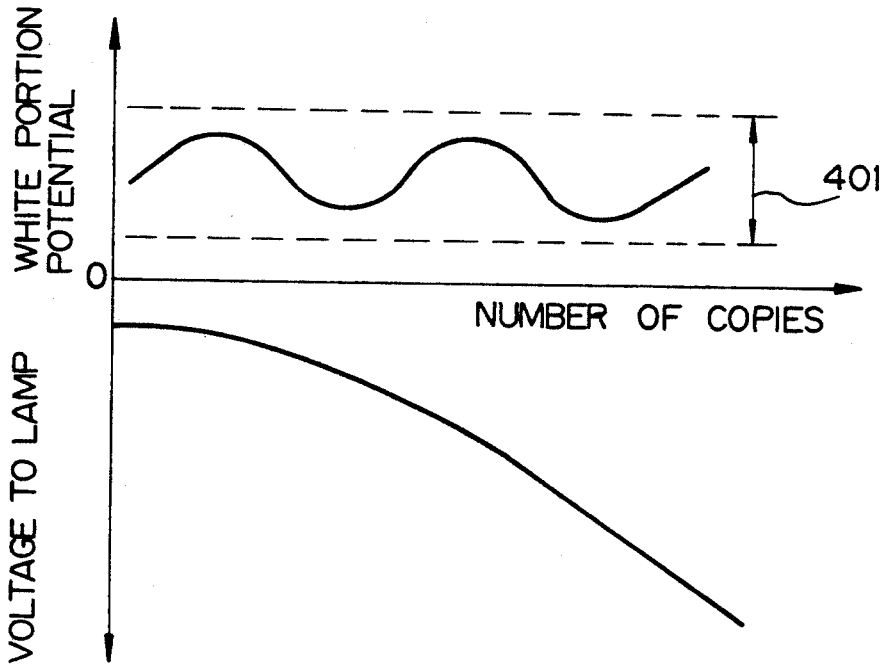
FIG. 4 is a graph showing a relation between the number of copies produced and the above-mentioned potential and a relation between the number of copies and the voltage to a lamp.

FIG. 4 shows a relation between the number of copies produced and the white portion potential associated with the white pattern 18, and a relation between the number of copies produced and the voltage to the lamp 102. The CPU 202 controls the lamp power source 205 on the basis of the program stored in the ROM 203 so as to increase the voltage to the lamp 102, so that the potential measured by the potential sensor 119 may lie in a white portion potential control range 401. As a result, the white portion potential on the drum 107 is substantially maintained in the predetermined range 401, whereby the above-mentioned background contamination is eliminated.

Figure 5:
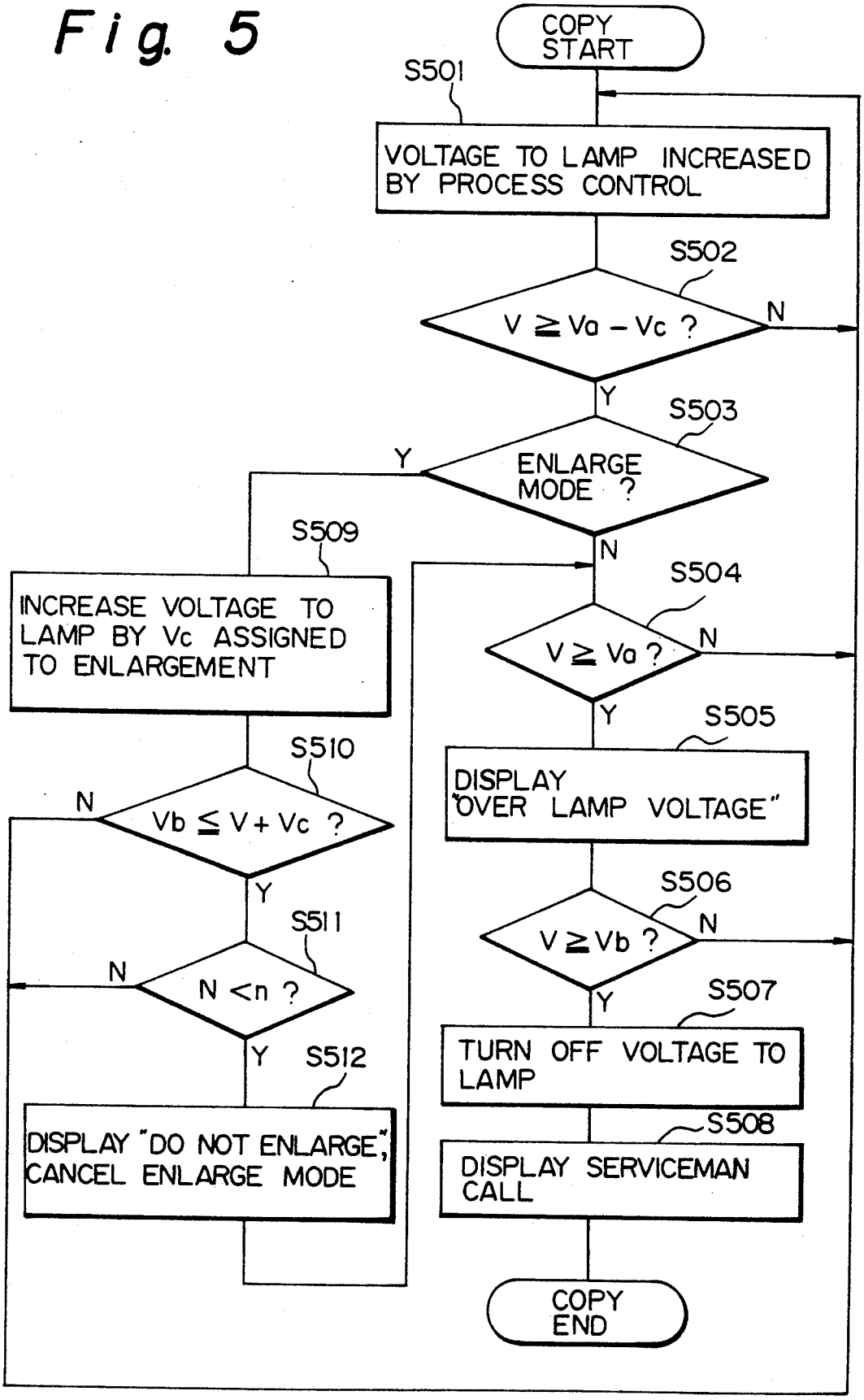
FIG. 5 is a flowchart demonstrating a specific operation of the embodiment.

FIG. 5 is a flowchart demonstrating a specific operation of the control system, e.g., CPU 202. As shown, as the number of copies produced increases, the voltage of the lamp 102 is sequentially increased by process control in order to confine the white portion potential on the drum 107 in a predetermined range (step S501). Then, the CPU 202 which constantly monitors the voltage V to the lamp 102 determines whether or not the voltage V is higher than or equal to Va−Vc (S502). If the answer of this step S502 is negative, N, the program returns to the step S501. If the answer of the step S502 is positive, Y, the CPU 202 determines whether or not the copier is in an enlarge mode (S503) and, if the answer is negative, determines whether or not the voltage V to the lamp 102 is higher than or equal to the set voltage Va stored in the RM 204 (S504). If the answer of the step S504 is positive, the CPU 202 displays a message such as "OVER LAMP VOLTAGE" on the displaying means of the operation and display panel 201 (S505). This message is to inform the operator of the fact that the voltage to the lamp 102 has increased until the life of the lamp 102 has almost ended. Further, the CPU 202 determines whether or not the voltage V of the lamp 102 is higher than or equal to the set voltage Vb also stored in the RAM 204 (S506). If the voltage V is higher than or equal to the set voltage Vb, the CPU 202 turns off the lamp power source 205 to thereby interrupt the voltage to the lamp 102 (S507). As a result, the voltage to the lamp 102 is constantly limited to below the set voltage Vb. In such a condition, since the drum 107 and other parts of the copier need maintenance, the CPU 202 displays a serviceman call on the displaying means of the operation and display panel 201.

As stated above, the CPU 202 informs the operator of the fact that the lamp 102 is about to break, before displaying a serviceman call due to the increase in the voltage to the lamp 102 beyond the set voltage Vb. Although the lamp 102 is generally assumed to have a life corresponding to tens of thousands of copies, it is likely that the life of the lamp 102 is overlooked since the lamp 102 is not of the nature needing frequent replacement. In light of this, the second limit voltage Va is selected to be slightly lower than the first limit voltage Vb in consideration of the life of the lamp 102. This is successful in preventing the lamp 102 from suddenly bursting.

When the drum 107 is replaced with new one, the white portion potential on the drum 107 is restored to the initial low potential with the result that the voltage V to the lamp 102 is again controlled at a low value. Then, the voltage V again becomes lower than the set voltage Va. Further, the voltage elevation data Vc changes with the magnification change ratio since the quantity of light necessary for exposure increases with the magnification change ratio. For these reasons, an arrangement is made such that the set voltages Va, Vb and Vc stored in the RMA 204 may be changed by entering desired values on the operation and display panel 201.

Referring again to FIG. 5, if the copier is in an enlarge mode as determined in the step S503, the CPU 202 increases the voltage to the lamp 102 for enlargement by Vc (S509). Then, the CPU 202 determines whether or not the set voltage is lower than or equal to V+Vc (S510). If the answer of this step S510 is positive, the CPU 202 compares a limited number of copies N for enlargement entered on the operation and display panel 201 and stored in the RAM 204 with the remaining number of copies n to be produced by the job now under way (S511). If n is greater than N, the CPU 202 displays a message such as "DO NOT ENLARGE" on the operation and display panel 201 and cancels the enlarge mode (S512). Thereafter, the operation returns to the step S504 and repeats the above-described sequence of steps.

In summary, it will be seen that the present invention provides an image forming apparatus capable of operating in an enlarge mode even when the voltage to a lamp exceeds a limited voltage, thereby enhancing not only safety operation but also cost performance.

Various modifications will become possible for those skilled in the art after receiving the teachings of the present disclosure without departing from the scope thereof.

What is claimed is:

1. An image forming apparatus for scanning a document by optics including a lamp to expose a photoconductive element by imagewise light and scanning a pattern having a reference density by said lamp to expose said photoconductive element by the resulting reflection to thereby electrostatically form a latent image representative of said pattern on said photoconductive element, said apparatus comprising:

voltage limiting means for limiting a voltage to said lamp to below a first set voltage on the basis of the potential of said latent image;

control means for producing an alarm on determining that the voltage to said lamp has reached a second set voltage lower than said first set voltage; and operating means for changing said second set voltage;

the limitation of said voltage to said lamp by said voltage limiting means being cancelable in an enlarge mode by a condition entered on said operating means.

2. An apparatus as claimed in claim 1, wherein said control means producing, when the sum of the voltage to said lamp and a voltage elevation for a magnification change mode is greater than said first set voltage of said lamp, an alarm inhibiting said apparatus from being operated in an enlarge mode if the remaining number of copies being processed in an enlarge mode is greater than a limited number of copies particular to an enlarge mode.

3. An apparatus as claimed in claim 1, wherein said control means producing, when the sum of the voltage to said lamp and a voltage elevation for a magnification change mode is greater than said first set voltage of said lamp, an alarm inhibiting said apparatus from being operated in an enlarge mode and invalidating an enlarge mode input if the remaining number of copies being processed in an enlarge mode is greater than a limited number of copies particular to an enlarge mode.

* * * * *